US008024819B2

(12) United States Patent
Gearhart

(10) Patent No.: US 8,024,819 B2
(45) Date of Patent: Sep. 27, 2011

(54) WEIGHTED UNDERGARMENT

(76) Inventor: Elizabeth Gearhart, Chatham, NJ (US)

( * ) Notice: Subject to any disclaimer, the term of this patent is extended or adjusted under 35 U.S.C. 154(b) by 22 days.

(21) Appl. No.: 12/006,646

(22) Filed: Feb. 28, 2008

(65) Prior Publication Data

US 2009/0025124 A1 Jan. 29, 2009

Related U.S. Application Data

(60) Provisional application No. 60/878,567, filed on Jan. 4, 2007.

(51) Int. Cl.
*A41D 1/08* (2006.01)
*A41B 9/02* (2006.01)

(52) U.S. Cl. ..... 2/238; 2/403; 2/69; 2/228

(58) Field of Classification Search ..... 2/227, 228, 2/238, 400–406, 69, 67, 273, 274
See application file for complete search history.

(56) References Cited

U.S. PATENT DOCUMENTS

| | | | | | |
|---|---|---|---|---|---|
| 1,004,439 | A * | 9/1911 | Knapp | ..... | 2/273 |
| 1,319,170 | A * | 10/1919 | Noble | ..... | 2/273 |
| 1,365,731 | A * | 1/1921 | Schloss | ..... | 2/273 |
| 1,388,802 | A * | 8/1921 | Cooper | ..... | 2/273 |
| 5,144,694 | A * | 9/1992 | Conrad Da oud et al. | ..... | 2/69 |
| 6,367,086 | B1 * | 4/2002 | Woodard | ..... | 2/237 |
| 7,376,979 | B2 * | 5/2008 | Nilsen | ..... | 2/69 |

* cited by examiner

*Primary Examiner* — Gloria Hale
(74) *Attorney, Agent, or Firm* — Gearhart Law LLC

(57) ABSTRACT

The invention prevents leg chafing, and keeps the garment from riding up in the wearer's crotch area, by disposing weights on the garment. If the garment is an undergarment, then Modal® fabric, a bio-based fiber made by spinning reconstituted cellulose from beech trees, is especially preferred, as it is extremely soft, and wicks away moisture in an effective manner. It is an object of the invention to reduce leg chafing. It is a further object of the invention to teach a method of preventing garments from riding up into the wearer's crotch area.

11 Claims, 2 Drawing Sheets

WEIGHTED UNDERGARMENT

CLAIM OF PRIORITY

This application claims the benefit of provisional application having application number U.S. 60/878,567 filed Jan. 4, 2007.

FIELD OF THE INVENTION

The invention relates to improvements in clothing, particularly to undergarments and outerwear to reduce chafing and bunching of the clothing in the crotch area.

BACKGROUND OF THE INVENTION

The increasing number of overweight citizens creates numerous and well known problems in the area of public health, and there are equally numerous public and private programs devoted to addressing the issues that arise from this trend. While some issues are serious and life threatening, there are other issues equally serous but rarely discussed. One of these issue is leg chafing. Chafing is a condition of soreness of the skin that occurs from the skin's repeatedly rubbing against an irritant, such as clothing or other skin. Leg chafing occurs when the skin of the upper thighs rubs together with movement such as walking or running. This can be very painful, and can lead to irritation of the upper thighs resulting in reddened, raw skin or rashes. In some extreme cases the skin can be completely rubbed off, leading to bleeding. The situation is worse on hot days, when the inner thighs perspire and the moisture adds to the discomfort. It also worsens when the upper thighs accumulate greater stores of fat.

Wearing shorts would protect the inner thighs if the fabric of the shorts stayed in place covering the thighs. In many cases, however, the shorts 'ride up', or bunch up into the crotch area with movement, such as walking. This is very uncomfortable and the fabric must be continually pulled back down.

One way to reduce chafing is to wear long pants, but this is uncomfortable for some people, especially on hot days, and can be extremely uncomfortable for very heavy people. Skirts would be more comfortable if a solution to the chafing could be found. Some heavy women also feel that skirts are more flattering than pants. Wearing pants also may not be feasible for professional women who must wear skirts at work.

SUMMARY OF THE INVENTION

The invention prevents leg chafing, and keeps the garment from riding up in the wearer's crotch area, by disposing weights on the garment. If the garment is an undergarment, then Modal® fabric, a bio-based fiber made by spinning reconstituted cellulose from beech trees, is especially preferred, as it is extremely soft, and wicks away moisture in an effective manner. It is an object of the invention to reduce leg chafing. It is a further object of the invention to teach a method of preventing garments from riding up into the wearer's crotch area.

DESCRIPTION OF THE PREFERRED EMBODIMENTS

Figure 1:
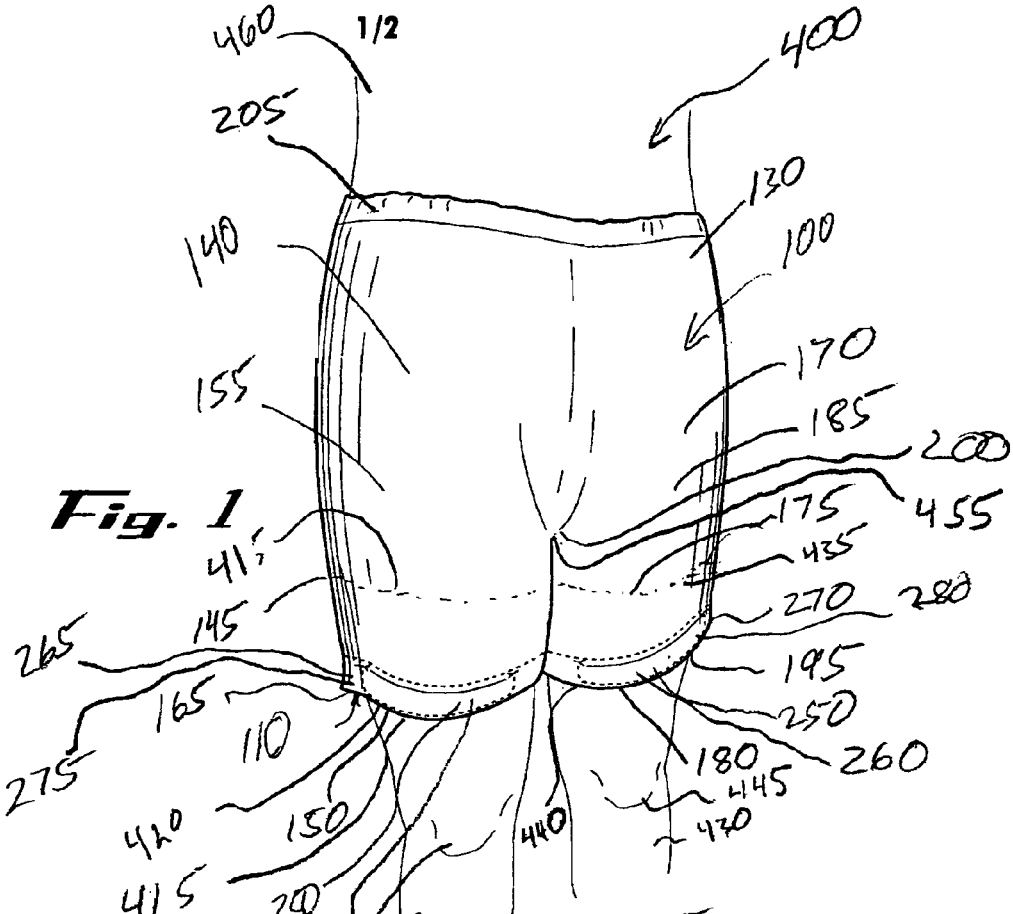
FIG. 1 is a perspective view of the preferred embodiment of the invention.

The preferred embodiments of the present invention will now be described with reference to FIGS. 1-6 of the drawings. Identical elements in the various figures are identified with the same reference numerals.

FIG. 1 illustrates the garment 100 according to the present invention. As can be seen, garment 100 is in the form of a pant. Garment 100 is most likely to be an undergarment, however, it could also be an outer garment such as a pair of short pants or athletic wear. In addition, the garment 100 can be worn over other undergarments, such as tight fitting pair of underwear. In the preferred embodiment, the garment is most likely to be worn under a skirt. In an alternative embodiment, garment 100 has sewn therein a crotch liner. The garment will have particular appeal to wearers who are overweight or pregnant. In an alternative embodiment, an elastane control panel will be sewn in over the stomach area.

FIG. 1 shows panels 130, specifically left panel 140, and right panel 170, crotch 200 and waist 205. Left panel 140 has left mid circumference 145, left bottom edge 150, left front panel 155, and left bottom edge circumference 165. Right panel 170 has right mid circumference 175, right bottom edge 180, right front panel 185, and right bottom edge circumference 195. Garment 100 also has inner surface 110. The "inner surface" is the entire surface area that faces the wearer. It can be calculated simply by calculating the surface area defined by the pattern used to make the garment. In addition, FIG. 1 shows weights 250, specifically left weight 255 and right weight 260, disposed in left pocket 265 and right pocket 270. Garment 100 also has left hem 275 and right hem 280.

Garment 100 is worn by human 400, having left leg 410, left knee 425, right leg 430, right knee 445, crotch area 455, and body surface 460.

Figure 2:
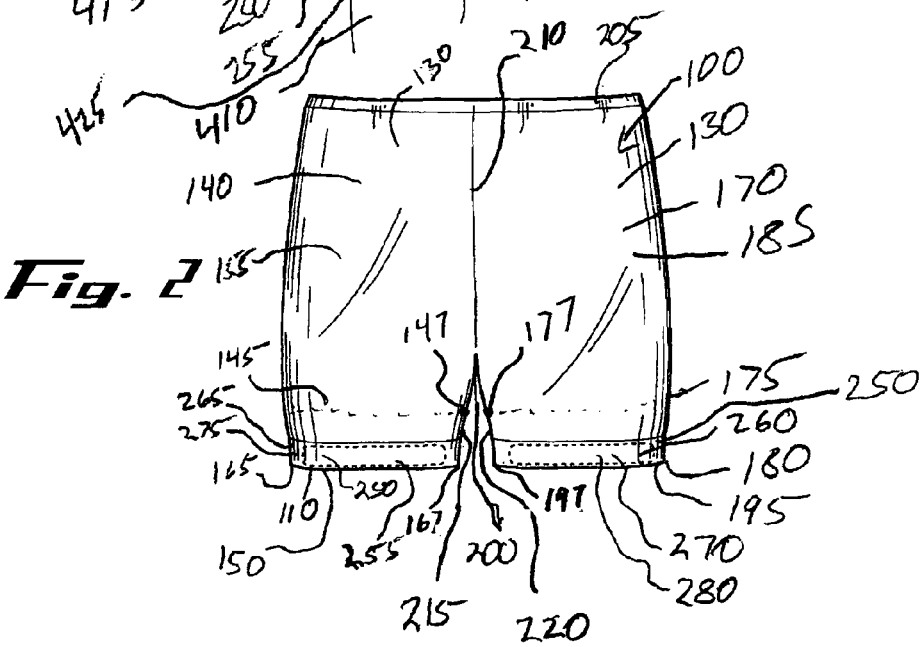
FIG. 2 is a front view of the preferred embodiment of the invention.

FIG. 2 shows panels 130, specifically left panel 140, and right panel 170, crotch 200 and waist 205. FIG. 2 also shows center seam 210, left inseam 215 and right inseam 220. Left panel 140 has left mid circumference 145, left bottom edge 150, left front panel 155, and left bottom edge circumference 165. Right panel 170 has right mid circumference 175, right bottom edge 180, right front panel 185, and right bottom edge circumference 195. Garment 100 also has inner surface 110. In addition, FIG. 2 shows weights 250, specifically left weight 255 and right weight 260, disposed in left pocket 265 and right pocket 270. Garment 100 also has left hem 275 and right hem 280. FIG. 2 shows left edge midpoint 147 and left bottom edge point 167, and right midpoint 177 and right bottom edge point 197.

Figure 3:
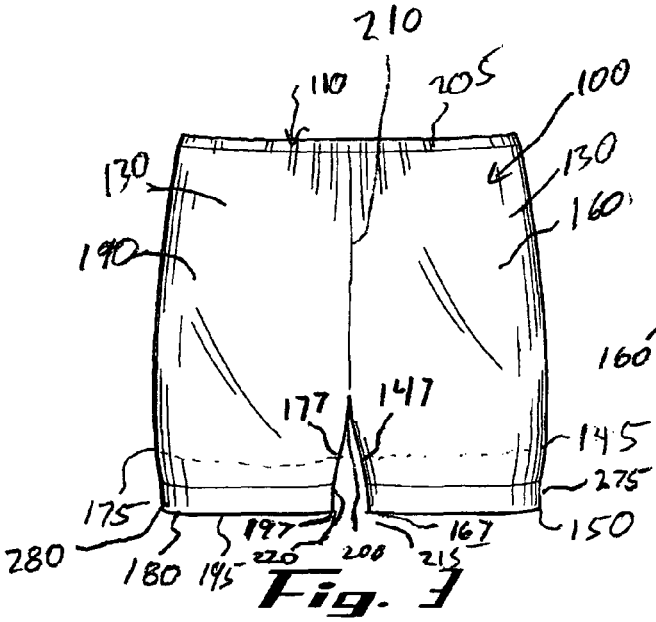
FIG. 3 is a rear view of the preferred embodiment of the invention.

FIG. 3 is a rear view of the invention, and shows panels 130, specifically left panel 140, and right panel 170, crotch 200 and waist 205. FIG. 3 also shows center seam 210, left inseam 215 and right inseam 220. Left panel 140 has left mid circumference 145, left bottom edge 150, left rear panel 160 and left bottom edge circumference 165. Right panel 170 has right mid circumference 175, right bottom edge 180, right rear panel 190, and right bottom edge circumference 195. Garment 100 also has inner surface 110. In addition, FIG. 3 shows weights 250, specifically left weight 255 and right weight 260, disposed in left pocket 265 and right pocket 270. Garment 100 also has left hem 275 and right hem 280. FIG. 3 shows left edge midpoint 147 and left bottom edge point 167, and right midpoint 177 and right bottom edge point 197.

Figure 4:
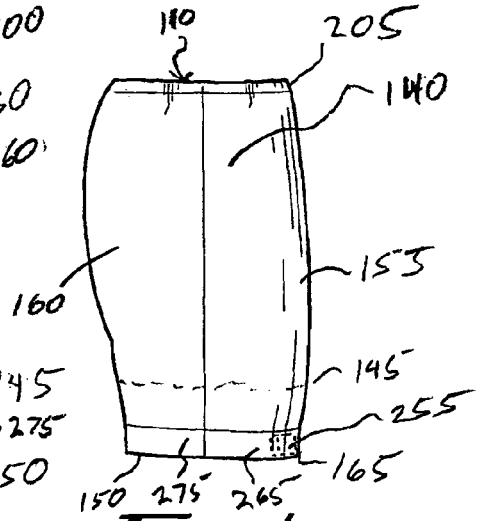
FIG. 4 is a side view of the preferred embodiment of the invention.

FIG. 4 is a side view of the invention, and shows left panel 140 and waist 205. Left panel 140 has left mid circumference 145, left bottom edge 150, left front panel 155, left rear panel 160 and left bottom edge circumference 165. Garment 100 also has inner surface 110. In addition, FIG. 4 shows left weight 255, disposed in left pocket 265. Garment 100 also has left hem 275.

Figure 5:
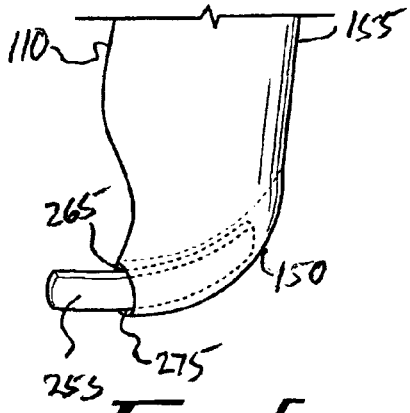
FIG. 5 is a detailed view of the preferred embodiment of the invention.

FIG. 5 is a detailed view of the invention, showing inner surface 110, left front panel 155, left bottom edge 150, left weight 255, left pocket 265 and left hem 275.

Figure 6:
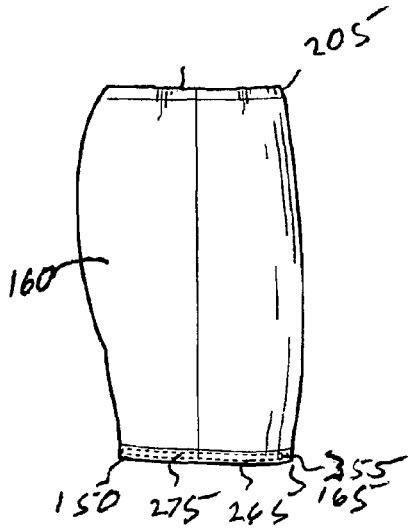
FIG. 6 is a side view of an alternate embodiment of the invention.

FIG. 6 is a side view of an alternative embodiment of the invention, and shows left panel 140 and waist 205. Left panel 140 has left mid circumference 145, left bottom edge 150, left front panel 155, left rear panel 160 and left bottom edge circumference 165. Garment 100 also has inner surface 110. In addition, FIG. 4 shows alternate left weight 355, disposed in left pocket 265. Garment 100 also has left hem 275. In the alternative embodiment, left weight 355 is roughly equivalent in size to left bottom edge circumference 165, and extends around entire left bottom edge 150 of the left panel 140. Likewise, right weight 360 is roughly equivalent in size to right bottom edge circumference 195, and extends around entire right bottom edge 180 of the left panel 170 (not shown).

The pant is loose fitting. "Loose fitting" in one embodiment means that the body surface 460 of the wearer contacts from at most ten to at most eight five percent of said inner surface 110 of garment 100. In other embodiments, the contact with the wearer can be at most thirty percent, at most fifty percent, at most seventy five percent, and at most eight five percent.

The percentage of contact can be measured by asking the wearer to remain motionless in a standing position, and marking the portions of the garment 100 which contact the wearer's body, calculating the total area that comes into contact with the wearer's body, then dividing by the inner surface area 110. The most preferred ratio is from 10 to 50%, however, the ratio can go as high eight five percent and still achieve the purposes of the invention.

Another method of determining if the pant is loose fitting is to determine the circumference of the leg panels in relation to the circumference of the wearer's leg. For example as seen in FIG. 1, garment 100 has left mid circumference 145, left bottom edge circumference 165, right mid circumference 175, and right bottom edge circumference 195. Each of these circumferences has a corresponding relational circumference to a point on a wearer's leg.

The mid circumferences are measured along points on the inseam which are equidistant between crotch 200 and the bottom edge of the pant, namely left bottom edge 150 and right bottom edge 180. The left mid circumference 145 of left panel 140 is measured at a point halfway between crotch 200 and left bottom edge 150 along left inseam 215. In a similar manner, the right mid circumference 175 of right panel 170 is measured at a point halfway between crotch 200 and right bottom edge 180 on right inseam 220.

The measurement is made with a wearer wearing the garment 100, while standing with normal posture, without shoes. An imaginary plane parallel to the ground intersects the left midpoint 147 and right midpoint 177. The circumference of the distance defined by the intersection of the plane and the garment 100 defines the mid circumference points, and the intersection of the plane and the wearer's leg defines the left and right mid leg circumferences. Thus, an imaginary plane parallel to the ground intersects left midpoint 147, and its intersection with left panel 140 creates a left mid circumference 145. The imaginary parallel plane also intersects wears left leg 410, and creates corresponding left leg mid circumference 415. Similarly for the right side, an imaginary plane parallel to the ground intersects right midpoint 177, and its intersection with right panel 170 creates a right mid circumference 175. The imaginary parallel plane also intersects wearer's right leg 430, and creates corresponding right leg mid circumference 435. Thus, through a relatively simple procedure, left and right mid circumferences can be determined, as well as corresponding left and right circumferences from the wearer's left and right legs.

A similar procedure is followed for obtaining left and right bottom edge circumferences, and corresponding left and right leg bottom edge circumferences. The bottom edge circumferences are measured along bottom edge points on the inseams 215 and 220, specifically left bottom edge points 167 and right bottom edge point 197.

The measurement is made with a wearer wearing the garment 100, while standing with normal posture, without shoes. An imaginary plane parallel to the ground intersects the left bottom edge point 167 and right bottom edge point 197. The circumference of the distance defined by the intersection of the plane and the garment 100 defines the bottom edge circumferences, and the intersection of the plane and the wearer's leg defines the corresponding left and right leg bottom edge circumferences. Thus, an imaginary plane parallel to the ground intersects left bottom edge point 167, and it's intersection with left panel 140 creates a left bottom edge circumference 165. The imaginary parallel plane also intersects wears left leg 410, and creates corresponding left leg bottom edge circumference 440. Similarly for the right side, an imaginary plane parallel to the ground intersects right bottom edge point 197, and its intersection with right panel 170 creates a right bottom edge circumference 195. The imaginary parallel plane also intersects wearer's right leg 430, and creates corresponding right leg bottom edge circumference 440. Thus, through a relatively simple procedure, left and right bottom edge circumferences can be determined, as well as corresponding left and right bottom edge circumferences from the wearers left and right legs.

In sum, as an alternative means of describing garment 100 as loose fitting for purposes of the invention, it is desirable for the mid and bottom edge circumferences to be at least 5% greater than the corresponding circumferences of the wearer's leg. Thus left mid circumference 145 should be at least 5% greater than corresponding left leg mid circumference 415, and right mid circumference of right panel 170 should be 5% greater than corresponding right leg mid circumference 435. In a similar manner, left bottom edge circumference 165 should be 5% greater than corresponding left leg bottom edge circumference 420, and right bottom edge circumference 195 should be 5% greater than corresponding right leg bottom edge circumference 440.

Garment 100 can be of any suitable length. The garment as shown in the FIGS. 1-6 is a pair of shorts, but alternatively could be a pair of long pants. If the garment is a pair of short pants, as shown in the drawings, the left and bottom edges 150 and 180 will likely extend past the first third of the distance defined by the length determined by the distance from the wearer's crotch area 455 to either the right knee 425 or left knee 455, (measure from crotch area 455) and may preferably extend past the midpoint defined by the distance from the wearer's crotch area 455 to either the right knee 425 or left knee 455.

The measurements for a size medium of one embodiment of the invention are displayed in the table below. This is for one design of the garment, and other designs may contain measurements that have been modified from this design. For instance, the length in this example is 7" for the inseam; a design of a longer garment may have an inseam of 10", or of any length desirable by the user.

| MEASUREMENTS: SIZE MEDIUM (8/10) | APPVD |
|---|---|
| WAIST WIDTH AT TOP EDGE | 13 ½ |
| WAIST WIDTH AT SEAM | 14 ¼ |
| WAIST LACE HEIGHT | 1 ½ |
| HIP 5" FM WAIST SEAM | 18 ½ |
| CF PANEL WIDTH AT WAIST SEAM | 2 ¾ |
| FRONT RISE FM WAIST SM TO CROTCH SM | 7 |
| BACK RISE FM WAIST SM TO CROTCH SM | 9 |
| CROTCH LENGTH | 4 ½ |
| CROTCH WIDTH ALONG FRONT SEAM | 3 ¼ |
| INSEAM | 7 |
| OUTSEAM FM WAIST SEAM | 14 ½ |
| THIGH AT CROTCH SEAM | 10 ¾ |
| LEG OPENING | 11 |
| LEG HEM HEIGHT | 1 ¼ |
| INSIDE LINING LENGTH | 5 |

Weights 250 can be disposed on the garment 100 in any manner, such as glued, sewn or otherwise mechanically attached to left panel 140 or right panel 170. Moreover, weights 250 can be attached at any point and in any orientation on panels 140 and 170, so long as the placement of the weights achieves the desired outcome of the invention, i.e., they are placed to prevent chafing and/or ride up on the wearer. Also, the number of weights disposed on panels is not critical, although in the preferred embodiment of the invention, there is one weight per panel. Preferably, weights 250 are disposed in left pocket 265 and right pocket 270. In preferred embodiments, the weights are proximately located to left bottom edge 150 and right bottom edge 180, respectively, with left pocket 265 and right pocket 270 also serving as left hem 275 and right hem 280. FIG. 5 shows a detailed view of the placement of left weight 255 in left pocket 265 and left hem 275. The pockets 265 and 270 can be covered or decorated in a suitable manner.

Weights 250 can be produced from any material, including but not limited to wood, metal, plastic, rubber, fabric or even glass or crystal, or any combination of materials. The weight can be any size or shape, but is preferably designed to create a minimum of awareness to the wearer. For example, the left panel 140 and right panel 170 will have a circumference at any point along left inseam 215 or right inseam 220. Weights 250 may have a length equal to one quarter, one half or one third of said circumference at the point along the inseam where the weight is disposed on the garment. The dimensions of the weights are typically rectangular, but could be any suitable shape, and can range in length from 3" to 15", from ¼" to 2" for the width, and from 1/64 to ½" in thickness, with preferable sizes being from 6" to 12" for length, ½" to 1½" for width, and from 1/32" to ¼" for thickness. A typically sized weight is 8" by 1" by 1/32$^{nd}$" and extends across the front panels 155 and 185 as illustrated in FIG. 2. In an alternative embodiment, the weight extends around the entire left and right panels, along the bottom edges, as seen in FIG. 6.

Exemplary plastics for the weights include but not limited to, ABS, thermoplastics, acetals such as Delrin and acetal copolymers; acrylics, such as extruded or cast; carbon fibers; fiberglass: Fluoropolymers, such as Teflon® PTFE (polytetrafluoroethylene), ETFE (ethylene tetrafluoroethylene) PFA (perfluoroalkoxy fluorocarbon) CTFE (chlorotrifluoroethylene) PVDF (Kynar) ECTFE (Halar) FEP (fluorinated ethylene-propylene) Rulon®; Garolite; Nylon; PEEK (polyetheretherketone), including Carbon-Filled PEEK and Glass-Filled PEEK; Polyamide-imides and Polycarbonates. Blends of these plastics are also contemplated.

Flexible materials for weights 250 that can withstand repeated trips to the washer and dryer are also preferred. For example, one particularly preferred material is vinyl. Vinyl is flexible, and can withstand the high temperatures associated with washing and drying. It is relatively inexpensive and can be die cut or molded into a variety of shapes. Various fillers, including but not limited to barium carbonate, glass beads, or barium sulfate can also be formulated with the vinyl to increase its density, and can comprise up to about 40 weight percent of the finished weight. Another preferred material is rubber, which has the same favorable qualities as vinyl for this purpose.

An ideal specific gravity of the material is in the range of from about 0.5 gm/cm$^3$ to about 4.0 gm/cm$^3$, with about 1.5 gm/cm$^3$ to about 2.5 gm/cm$^3$ being preferred, with about 1.5 gm/cm$^3$ being most preferred. Moreover, the weights may be dyed to match the fabric of the garment.

Waist 205 will typically be elastic, but could also be a control panel. Control panels are typically made from Elastane® and can be sown into the garment as a band in the front or extend around the entire waist of the garment.

Finally, the fabric is of critical importance. The invention can be made of any fabric, such as cotton, rayon, nylon, polyester, silk, Spandex®, bamboo, viscose, and blends thereof, including blends with fabrics not specifically disclosed herein.

A highly preferred fabric is Modal® from Lenzing, AG in Austria. Modal® is a bio-based fiber made by spinning reconstituted cellulose from beech trees. It is about 50% more hygroscopic, or water-absorbent, per unit volume than cotton is. It is designed to dye just like cotton, and is color-fast when washed in warm water. Modal® is essentially a variety of rayon. Textiles made from Modal® do not fibrillate, or pill, like cotton does, and are resistant to shrinkage and fading. They are smooth and soft, more so than even mercerized cotton, to the point where mineral deposits from hard water, such as lime, do not stick to the fabric surface. Modal®, or other similar products produced from reconstituted cellulose are highly preferred. Modal® can be blended with other fabrics such as, but not limited to, cotton, silk, Spandex®, and bamboo.

Although this invention has been described with a certain degree of particularity, it is to be understood that the present disclosure has been made only by way of illustration and that numerous changes in the details of construction and arrangement of parts may be resorted to without departing from the spirit and the scope of the invention.

I claim:

1. A garment to be worn on a wearer's body, comprising:

a pant having:

left front and back panels and right front and back panels joined so as to provide a left pant leg and a right pant leg, each with a lower pant leg end such that, when said pant is worn by a wearer having a wearer's body waist substantially equal in diameter to a waist of said pant, said lower pant leg ends are disposed above a wearer's knee, and below a wearer's crotch area at least one third of a distance from said wearer's crotch area to said wearer's knee;

left and right pockets situated proximate to said respective lower pant leg ends; and left and right weights contained in said pockets such that said weights extend horizontally from adjacent to a vicinity of a mid-point of a wearer's thigh front, to a vicinity of a join between said front and back panels on each corresponding one of said pant legs.

2. The garment of claim 1, wherein said left and right pockets are left and right lower hems of said left and right pant legs.

3. The garment of claim 1, wherein the pant is made from a variety of rayon, bamboo, or blends thereof.

4. The garment of claim 1, wherein the weight is made from material selected from the group consisting of metal, plastic or rubber, and the weight has a smooth surface on both sides.

5. The garment of claim 1, wherein the weight is made from material selected from the group consisting of magnet or butyl rubber.

6. The garment of claim 1, wherein the garment is an undergarment.

7. The garment of claim 1, wherein said garment has a waist, and said waist is a control panel.

8. The garment of claim 1, wherein said garment has a crotch liner.

9. The garment of claim 1, wherein said garment further comprises an elastic control panel sewn in over the stomach area.

10. The garment of claim 1, wherein the left and right pant legs have a bottom edge;

the wearer has a midpoint, the wearer's midpoint defined as the point half-way along the line drawn from the wearer's crotch to the wearer's knee;

wherein, the bottom edge of the left and right pant legs extends past the wearer's midpoint.

11. The garment of claim 1 wherein the weight is vinyl and has a filler.

* * * * *